US007055210B2

(12) United States Patent
Keppler et al.

(10) Patent No.: US 7,055,210 B2
(45) Date of Patent: Jun. 6, 2006

(54) FLOOR TREATMENT SYSTEM WITH SELF-PROPELLED AND SELF-STEERING FLOOR TREATMENT UNIT

(75) Inventors: Joachim Keppler, Winnenden (DE); Jochen Math, Auenwald (DE); Roger Skoumal, Korb (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 11/030,011

(22) Filed: Jan. 4, 2005

(65) Prior Publication Data

US 2005/0166352 A1 Aug. 4, 2005

Related U.S. Application Data

(63) Continuation of application No. PCT/EP03/06224, filed on Jun. 13, 2003.

(30) Foreign Application Priority Data

Jul. 8, 2002 (DE) ..... 102 31 388

(51) Int. Cl.
*A47L 9/28* (2006.01)

(52) U.S. Cl. ..... 15/319; 15/340.1; 15/340.3

(58) Field of Classification Search ..... 15/319, 15/340.1, 323, 339, 340.3; 439/660, 919, 439/929

See application file for complete search history.

(56) References Cited

U.S. PATENT DOCUMENTS

| | | | | |
|---|---|---|---|---|
| 5,012,886 | A | 5/1991 | Jonas et al. | 15/319 |
| 5,444,893 | A | 8/1995 | Hwang et al. | 15/319 |
| 6,076,226 | A | 6/2000 | Reed | 15/319 |

FOREIGN PATENT DOCUMENTS

| | | |
|---|---|---|
| DE | 43 30 475 | 3/1994 |
| DE | 298 24 552 | 7/2001 |
| EP | 0 274 310 | 7/1988 |
| WO | 99/28800 | 6/1999 |

*Primary Examiner*—Theresa T. Snider
(74) *Attorney, Agent, or Firm*—Lipsitz & McAllister, LLC

(57) ABSTRACT

The invention relates to a floor treatment system with a self-propelled and self-steering floor treatment unit, which comprises an electrically driven floor treatment assembly and also a rechargeable power supply unit, and with a central charging station for recharging the power supply unit, the floor treatment unit being capable of being electrically connected to the charging station by means of respective electrical connecting elements disposed on the charging station and the floor treatment unit. In order to develop the floor treatment system in such a way that improved electrical coupling of the respective connecting elements is made possible, it is proposed according to the invention that at least one of the respective connecting elements is spring-mounted.

16 Claims, 4 Drawing Sheets

FLOOR TREATMENT SYSTEM WITH SELF-PROPELLED AND SELF-STEERING FLOOR TREATMENT UNIT

This application is a continuation of international application number PCT/EP 03/06224 filed on Jun. 13, 2003, and claims the benefit of German patent application number 102 31 388.1 filed on Jul. 8, 2002.

The present disclosure relates to the subject matter disclosed in international application number PCT/EP 03/06224 of Jun. 13, 2003 and German application number 102 31 388.1 of Jul. 8, 2002, which are incorporated herein by reference in their entirety and for all purposes.

BACKGROUND OF THE INVENTION

The invention relates to a floor treatment system with a self-propelled and self-steering floor treatment unit.

Self-propelled and self-steering floor treatment units can be used for treating, in particular cleaning, a floor surface without the floor treatment unit having to be moved across the floor surface by an operator. Rather, the floor treatment unit is configured in such a way that it automatically travels across the floor surface and treats it. If it meets an obstacle, this is detected by the floor treatment unit, which then changes its direction of travel to avoid the obstacle.

The treatment of the floor surface is performed by means of a floor treatment assembly which is carried along by the floor treatment unit and is supplied with electrical power by a power supply unit. The charging state of the power supply unit is monitored by an electrical control system of the floor treatment unit. If the charging state falls below a predetermined limit value, the floor treatment unit heads automatically for the central charging station, at which the power supply unit can be recharged. For this purpose, respective electrical connecting elements that are associated with one another and by means of which the electrical power can be transferred are disposed on the floor treatment unit and on the charging station. Floor treatment systems of this type are known for example from WO 99/28800, DE 298 24 552 U and from U.S. Pat. No. 6,076,226 A.

For transferring electrical power from the charging station to the floor treatment unit with as little loss as possible, it is necessary that the respective electrical connecting elements can be electrically coupled to one another. It has been found that, with known floor treatment systems, an electrical coupling of this type cannot be reliably achieved in all cases.

It is an object of the present invention to develop a floor treatment system of the type stated above in such a way that improved electrical coupling of the respective connecting elements is made possible.

SUMMARY OF THE INVENTION

This object is achieved by a floor treatment system with a self-propelled and self-steering floor treatment unit in accordance with the present invention.

By spring mounting of at least one of the respective connecting elements that are associated with one another, the electrical coupling of the connecting elements during docking-on of the floor treatment unit at the associated charging station can be improved. A spring mounting of this type has the effect in particular that, when it runs up against the charging station, the floor treatment unit, which is relatively light in comparison with the charging station, is not pushed back from the charging station with the effect that the respective connecting elements are then so far apart from one another that effective power transfer is no longer possible.

The use of at least one spring-mounted electrical connecting element is therefore advantageous above all because the floor treatment unit has, according to the invention, a collision detection sensor with an associated spring-mounted sensing element, the movement of which in relation to a chassis of the floor treatment unit can be sensed to provide a collision detection signal. For example, a bumper bar which surrounds the floor treatment unit in the peripheral direction and is spring-mounted in relation to a chassis of the floor treatment unit, so that the bumper bar performs a relative movement with respect to the chassis when the floor treatment unit meets an obstacle, may be used. This relative movement is detected by the collision detection sensor of the floor treatment unit, which then changes its direction of travel. Collision detection sensors of this type are known for example from EP 0 274 310 B1. When the floor treatment unit with a collision detection sensor of this type comes up against the charging station, there is the risk of the impact triggering a collision detection signal and the floor treatment unit subsequently reversing its direction of travel, so that electrical coupling of the respective connecting elements that are associated with one another is not possible. If, however, at least one of the connecting elements is spring-mounted, the spring excursion made possible for the connecting element allows the floor treatment unit briefly to retain its original direction of travel without the collision detection sensor already being activated and triggering a reversal of the direction of travel, while however the respective connecting elements can already enter into electrical contact with one another and consequently a charging current can flow from the charging station to the power supply unit of the floor treatment unit. The charging current can be detected by the control system of the floor treatment unit, so that a subsequent collision detection signal of the collision detection sensor can be suppressed. This ensures that, during docking, the floor treatment unit does not detect the charging station as an obstacle that is to be avoided. Rather, the floor treatment unit assumes a desired position with respect to the charging station for the recharging of the power supply unit, so that the respective connecting elements can enter into electrical connection with one another.

According to the present invention, the spring constant of the spring-mounted electrical connecting element is less than the spring constant of the collision detection sensor. It can be ensured thereby in a constructionally simple way that a charging current can flow before the collision detection sensor with the spring-mounted sensing element, for example a bumper bar surrounding the floor treatment unit in the peripheral direction, detects a collision and triggers a reversal of the direction of travel. The use of a lower spring strength for the spring-mounted connecting element than for the spring-mounted sensing element of the collision detection sensor makes it possible, in particular during docking of the floor treatment unit onto the central charging station, to suppress a collision detection signal until the charging process is completed. Once recharging has been performed, the charging state exceeds a predeterminable limit value, so that the collision detection signal can subsequently be enabled and the floor treatment unit consequently carries out a reversal of its direction of travel and continues the treatment of the floor surface.

The electrical coupling of the respective connecting elements can be performed without contact, in that electrical power can be transferred inductively or capacitively.

In the case of a preferred embodiment, it is provided that the respective connecting elements form electrical contact elements for the resistive coupling of the floor treatment unit to the charging station. This makes a particularly simple construction of the associated connecting elements possible, it being required for the transfer of electrical power that the connecting elements configured as electrical contact elements touch one another, so that a charging current can flow.

It has proven to be advantageous if the floor treatment system has at least two first connecting elements, with which at least one second connecting element is respectively associated. The use of a number of first and second connecting elements which are respectively disposed on the floor treatment unit and on the charging station ensures that, even if there is imprecise alignment of the floor treatment unit in relation to the charging station, a mechanical coupling of at least one first connecting element to a second connecting element can be achieved.

In this way it is possible for example to compensate for incorrect orientation of the floor treatment unit in the vertical direction by the first connecting elements being vertically spaced apart.

In the case of a preferred embodiment, it is provided that a number of spaced-apart second connecting elements are associated with at least one first connecting element. In this respect it is particularly advantageous if, depending on the alignment of the floor treatment unit in relation to the charging station, one or more of the second connecting elements can be electrically connected to a first connecting element. If there is optimum alignment of the floor treatment unit in relation to the charging station, for example, two second connecting elements can be electrically connected to a common first connecting element, whereas if the floor treatment unit is misaligned only one second connecting element can be connected to the associated first connecting element.

It has proven to be advantageous if the second connecting elements are disposed in a preferably horizontally aligned plane. In this way it is possible for example for a number of second connecting elements to be disposed next to one another in the horizontal direction on the charging station or on the floor treatment unit.

A particularly reliable coupling of the respective connecting elements can be achieved by at least one of the connecting elements being configured in an areal form. The areal form of configuration provides an extensive contact area, which simplifies the transfer of electrical power.

The areal connecting element may, for example, take the form of a strip.

The areal connecting element is preferably spring-mounted.

It may for example be provided that the areally configured connecting element forms a leaf spring. This makes possible low-cost production and assembly of the spring-mounted connecting element.

It is of advantage if the areally configured connecting element is disposed on the charging station.

In the case of a preferred embodiment, a number of contact elements are associated with the areally configured connecting element. This provides the possibility that, during docking of the floor treatment unit onto the charging station, at least one of the contact elements meets the associated, areally configured connecting element, so that a charging current can flow.

In the case of a particularly preferred embodiment of the floor treatment system according to the invention, it is provided that two horizontally aligned, leaf-spring-like connecting elements are disposed on the charging station one above the other, respectively associated with which are at least two contact elements mounted on the floor treatment unit. Voltages of different polarity may be applied here to the two leaf-spring-like connecting elements by a power source of the charging station.

As mentioned above, the floor treatment system according to the present invention facilitates inter alia the cleaning of a floor surface. For this purpose, the floor treatment unit may form a mobile suction device with a suction turbine and with a dirt receiving container having a suction inlet. Starting from the suction inlet, a suction flow can be generated by the suction turbine, so that dirt can be picked up from the floor surface and transferred into the dirt collecting container.

It is of advantage here if a brush roller with sweeping brushes reaching through the suction inlet is mounted at the suction inlet in such a way that it can be rotationally driven. This makes it possible not only for the floor surface to be vacuum-cleaned but also brushed.

It is advantageous if the charging station comprises a suction-extraction assembly and a dirt receiving container, it being possible during the recharging of the power supply unit for the dirt collecting container to be emptied at the same time by the suction-extraction assembly via the suction inlet. During the docking of the floor treatment unit at the charging station, it is consequently possible not only for power to be transferred for the recharging of the power supply unit of the mobile suction device, but also for the dirt collecting container of the suction device to be emptied.

BRIEF DESCRIPTION OF THE DRAWINGS

The present invention will hereinafter be described in conjunction with the appended drawing figures, wherein like reference numerals denote like elements, and.

DETAILED DESCRIPTION OF THE INVENTION

Figure 1:
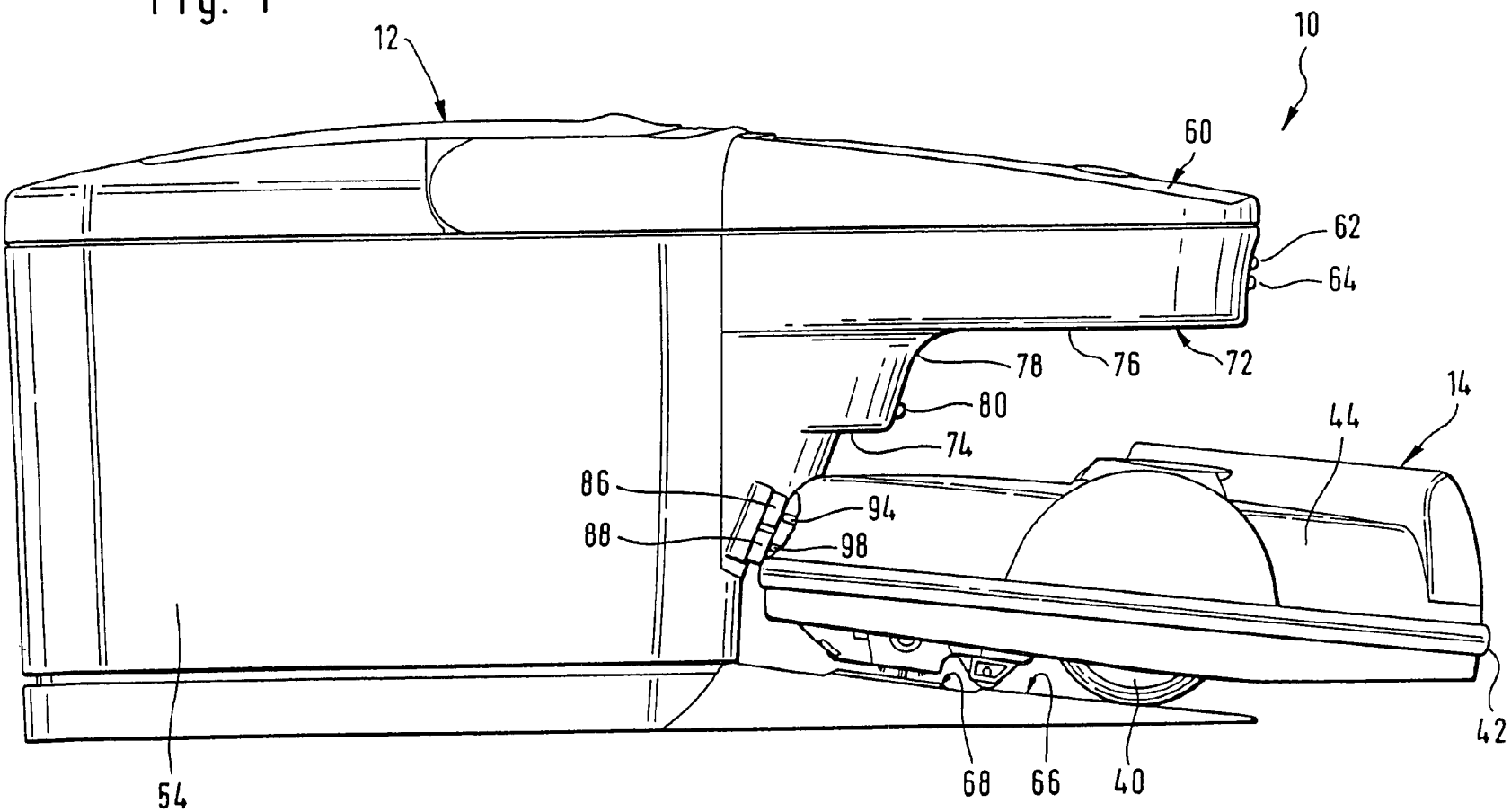
FIG. 1 shows a schematic side view of a floor treatment system according to the invention.

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

The drawings show a floor treatment system according to the present invention in the form of a floor cleaning system, which is designated as a whole by the reference numeral 10 and comprises a central charging station 12 and a self-propelled and self-steering floor treatment unit in the form of a mobile suction device 14.

The suction device 14 is formed as a mobile cleaning robot and has a housing 16 with a top wall 18 and a bottom wall 20, which between them define a suction channel 22. In its rear region, the housing 16 carries a suction turbine 26, which is driven in a rotating manner by an electrical drive motor 24 and is in flow connection with the suction channel 22 via an intake connector 28.

The bottom wall 20 has in its front region, facing away from the suction turbine 26, a suction inlet 30, reaching through which are sweeping brushes 32 of a brush roller 34 which can be driven in a rotating manner. Disposed inside the suction channel 22 is a dirt filter 36, and the region between the brush roller 34 and the dirt filter 36 forms a dirt collecting container 38. For cleaning the floor surface, a suction flow is generated by the suction turbine 26. The suction flow enables dirt to be transferred from the floor surface through the suction inlet 30 into the dirt collecting container 38. The picking up of dirt from the floor surface is assisted here by the brush roller 34.

The housing 16 forms a chassis of the mobile suction device 14, on which two drive wheels 40 are rotatably mounted in a way which is known per se and is therefore not represented in the drawing. The drive wheels 40 are driven by drive motors (not shown) as is known in the art.

Figure 2:
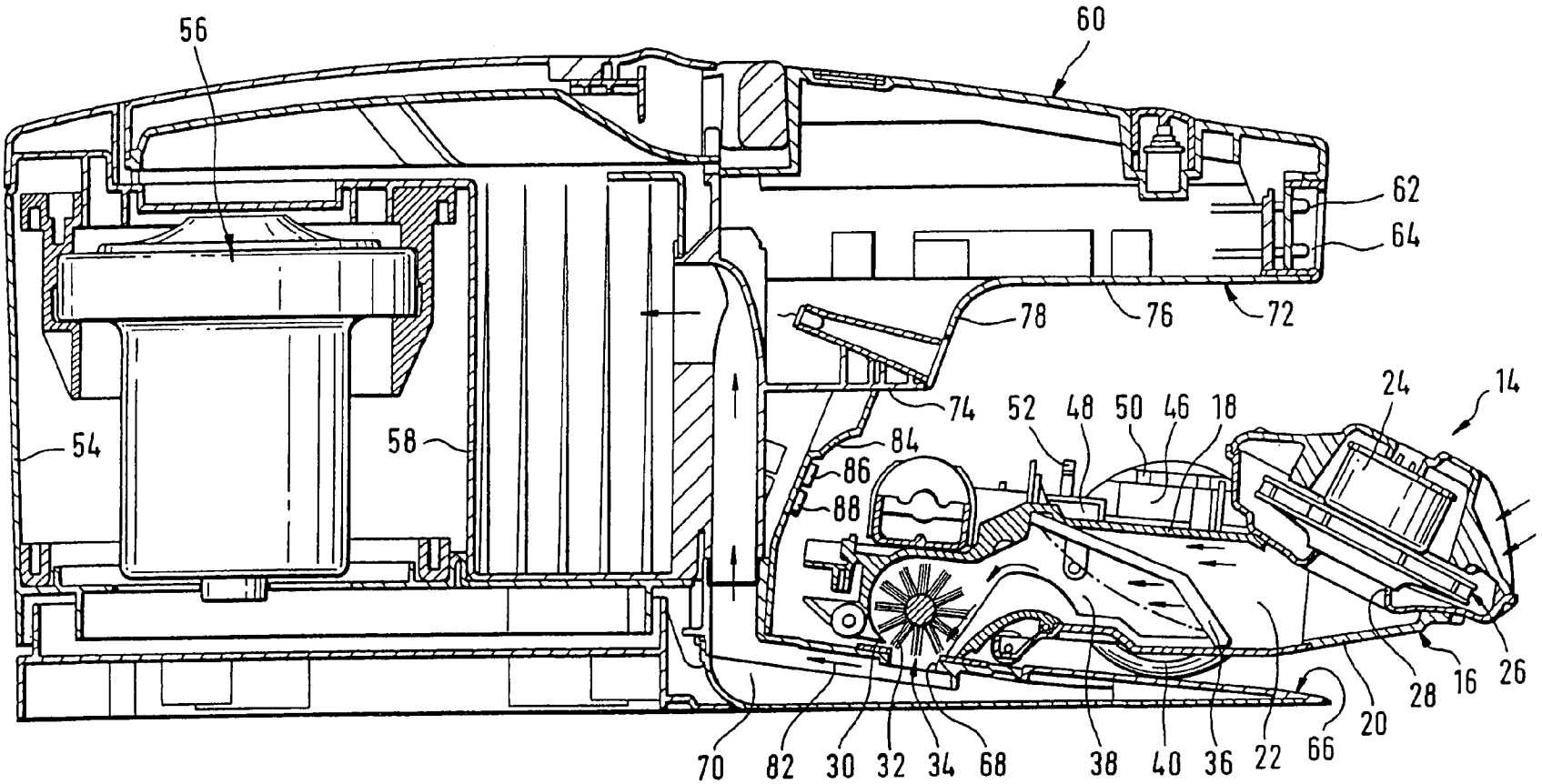
FIG. 2 shows a longitudinal sectional view of the floor treatment system according to FIG. 1.
Figure 3:
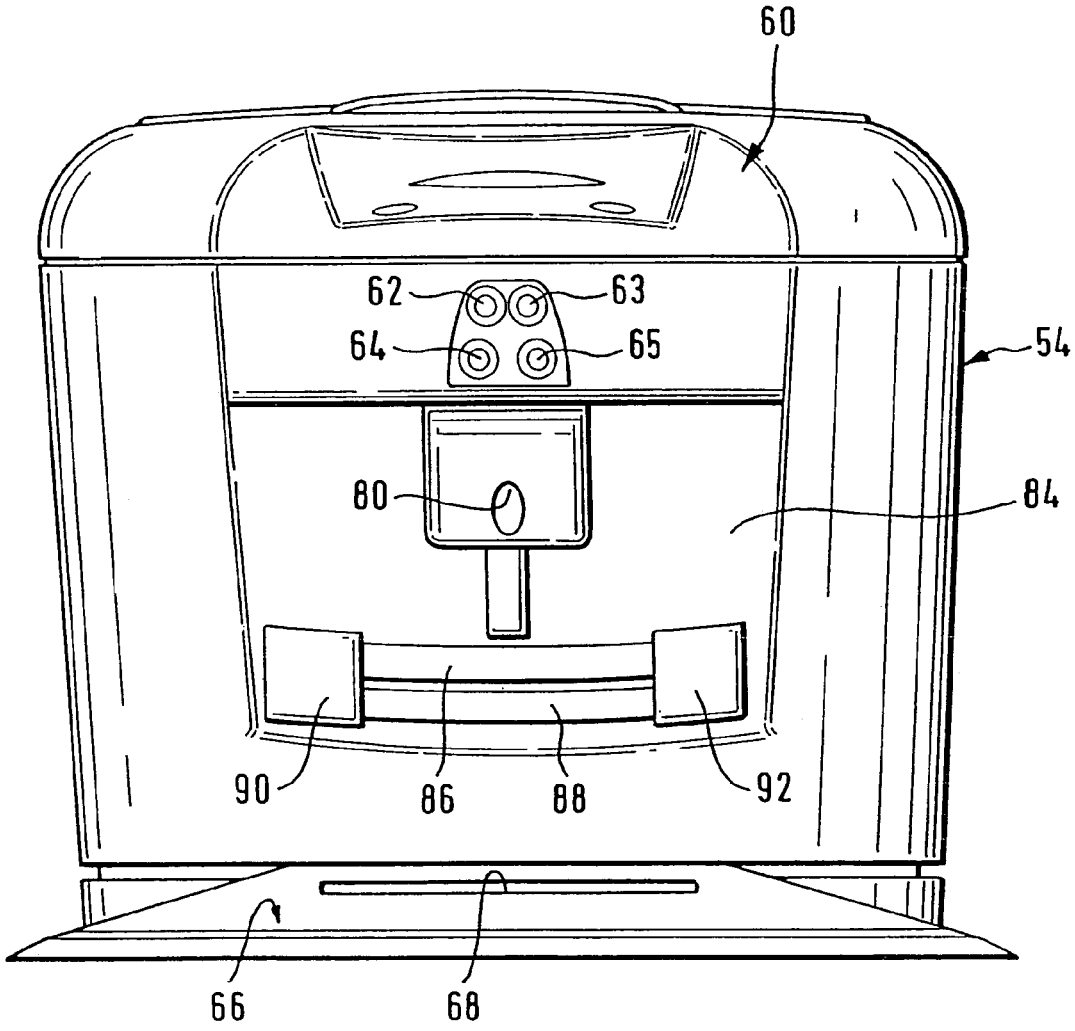
FIG. 3 shows a front view of a charging station of the floor treatment system.

As is clear from FIG. 1, the housing 16 is surrounded in the peripheral direction by a sensing ring 42, which is spring-mounted on the housing 16 and on which a cover 44 is fitted. To achieve better overall clarity, the sensing ring 42 and the cover 44 are not represented in FIG. 2.

The top wall 18 carries a rechargeable power supply unit in the form of a rechargeable battery 46 and additionally receives an electrical control system 48 as well as two infrared-sensitive sensors 50 and a Hall sensor 52 respectively in the region above a drive wheel 40. By means of the Hall sensor 52, a relative movement of the cover 44 fitted on the sensing ring 42 with respect to the housing 16 can be detected. If such a relative movement occurs, a collision detection signal is transmitted from the Hall sensor 52 to the control system 48. Such a relative movement occurs when the suction device 14 meets an obstacle. On the basis of the collision detection signal, the direction of travel of the suction device 14 can be changed, in particular a reversal of direction can be performed.

By means of the two infrared-sensitive sensors 50 disposed above the drive wheels 40, a target radiation emitted by the charging station 12 can be received, so that when the charging state of the battery 46 falls below a predetermined limit value, the suction device 14 can automatically travel to the charging station 12 for recharge of the battery 46.

The charging station has a housing 54, which surrounds a suction-extraction assembly 56 and a dirt receiving container 58, which can be subjected to negative pressure by the suction-extraction assembly 56.

Mounted on the side of the housing 56 is an extension arm 60, which at its free end carries four infrared-emitting diodes 62, 63, 64, 65. Formed onto the housing 54 of the charging station 12 underneath and at a distance from the extension arm 60 is a ramp 66, which has a suction-extraction opening 68. The suction-extraction opening 68 is adjoined by a suction-extraction channel 70, which forms a flow connection between the suction-extraction opening 68 and the dirt receiving container 58.

The extension arm 60 has on its underside, facing the ramp 66, a stepped carrying plate 72, with a rear carrying plate portion 74, facing the housing 54, and a front carrying plate portion 76, facing away from the housing 54, which are connected to one another in one piece by means of a step 78. Disposed on the step 78 is a further infrared-emitting diode 80. The infrared-emitting diodes 62, 63, 64, 65 and 80 emit an infrared target radiation, which is sensed in a directionally dependent manner by the infrared-sensitive sensors 50 of the suction device 14 and with the aid of which the suction device 14 can automatically head for the charging station 12. As this happens, the suction device 14 runs onto the ramp 66 during the docking-on at the charging station 12, so that the suction inlet 30 is aligned with the suction-extraction opening 68. By forming a suction-extraction flow, symbolised in FIG. 2 by the arrows 82, dirt can then be transferred from the dirt collecting container 38 of the mobile suction device 14 via the suction inlet 30 into the dirt receiving container 58 of the charging station 12. At the same time, the battery 46 of the suction device 14 is recharged. For this purpose, two electrical connecting elements in the form of two leaf springs 86, 88 are mounted on a supporting wall 84, which connects the rear carrying plate portion 74 of the extension arm 60 to the ramp 66, the springs being restrained between two supporting elements 90, 92 fixed to the supporting wall 84. The two biased and convexly curved leaf springs 86 and 88 are connected by means of connecting lines (not represented in the drawing) to a positive terminal and the negative terminal, respectively, of an electrical voltage source of the charging station 12, which is known per se and therefore not represented in the drawing. The voltage source can be connected to the supply voltage by means of a power cable known per se.

Figure 4:
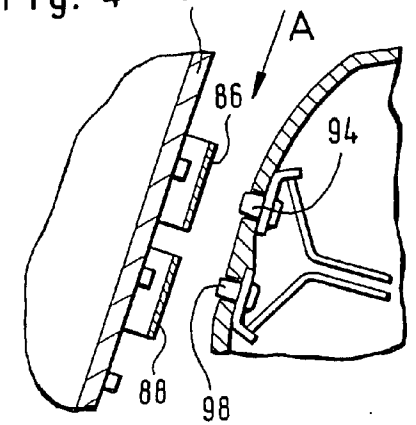
FIG. 4 shows an enlarged sectional view of detail X from FIG. 1 when electrical connecting elements of the floor treatment system that are associated with one another are approaching one another.
Figure 5:
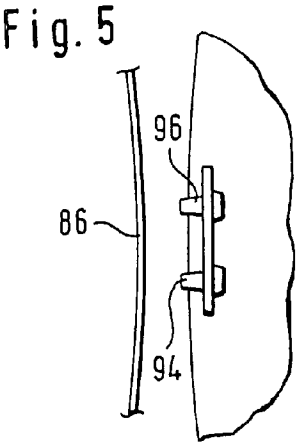
FIG. 5 shows a view in the direction of arrow A from FIG. 4.
Figure 6:
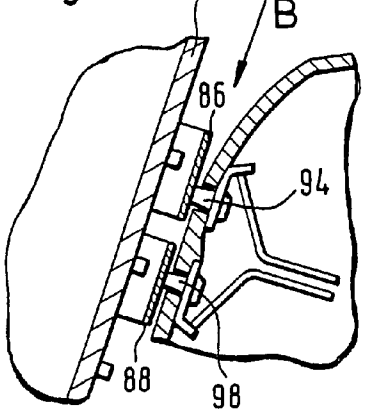
FIG. 6 shows an enlarged sectional view of detail X from FIG. 1 when the respective electrical connecting elements that are associated with one another are meeting.
Figure 7:
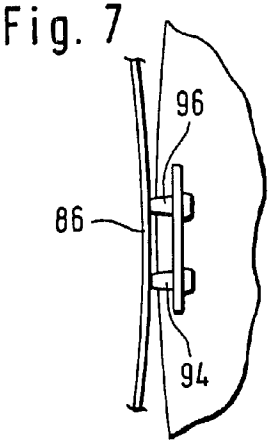
FIG. 7 shows a view in the direction of arrow B from FIG. 6.

Respectively associated with the two leaf springs 86 and 88 are two electrical contact pins, which are rigidly mounted on the cover 44 of the suction device 14. A first contact pin 94 and a second contact pin 96 interact here with the leaf spring 86, and a third contact pin 98, positioned underneath the first contact pin 94, and also a fourth contact pin (not represented in the drawing), disposed underneath the second contact pin 96, interact with the leaf spring 88. This is clear in particular from FIGS. 4 and 5. If the contact pins meet the two leaf springs 86 and 88, as is represented in FIGS. 6 and 7, electrical power can be transferred from the charging station 12 to the suction device 14, in that a charging current flows to the battery 46 via the leaf springs 86, 88 and the contact pins.

Figure 8:
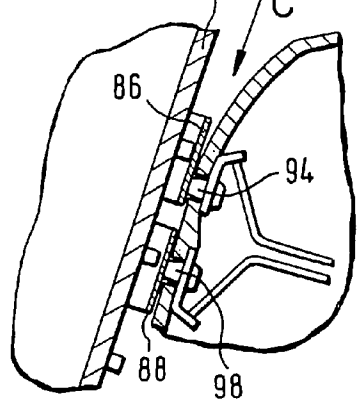
FIG. 8 shows an enlarged sectional view of detail X from FIG. 1 after the respective electrical connecting elements that are associated with one another have completed a spring excursion.
Figure 9:
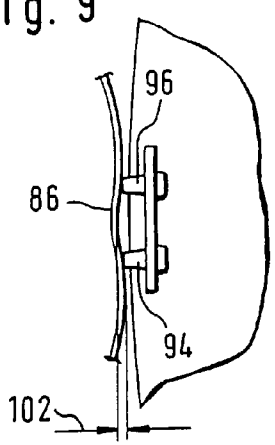
FIG. 9 shows a view in the direction of arrow C from FIG. 8.

As is clear from FIGS. 8 and 9, if the suction device 14 comes closer to the charging station 12, this has the effect that, on account of their elasticity, the two leaf springs 86 and 88 execute a deflection movement along a spring excursion 102 represented in FIG. 9. The spring constant of the two leaf springs 86 and 88 is chosen here to be less than the spring constant of the spring mounting of the sensing ring 42. This ensures that the leaf springs 86 and 88 can in first instance execute a resilient deflection movement and a charging current can flow, before a collision detection signal is provided by the Hall sensor 52 on the basis of a relative movement of the cover 44 and the sensing ring 42 with respect to the housing 16. Accordingly, when the suction device 14 comes up against the charging station 12, in first instance the flowing of a charging current to the battery 46 is detected by the control system 48, so that a collision detection signal which subsequently appears can be suppressed until the charging process is completed. Subsequently, the collision detection signal is enabled, so that the suction device 14 carries out a reversal of its direction of travel and then moves in the direction away from the charging station 12. The recharging of the battery 46 and the simultaneous suction-emptying of the dirt collecting container 38 is thereby completed, and the suction device 14 can resume its normal operation for cleaning the floor surface.

The invention claimed is:

1. Floor treatment system comprising:

a self-propelled and self steering floor treatment unit having an electrically driven floor treatment assembly and a rechargeable power supply unit, and a central charging station for recharging the power supply unit, wherein:

the floor treatment unit is adapted to be electrically connected to the charging station by means of respective electrical connecting elements disposed on the charging station and on the floor treatment unit;

at least one of the respective connecting elements is spring-mounted;

the floor treatment unit comprises a collision detection sensor with an associated spring-mounted sensing element, the movement of the sensing element in relation to a chassis of the floor treatment unit can be sensed to provide a collision detection signal; and the spring mounting of the at least one electrical connecting element has a lower spring constant than the spring mounting of the sensing element.

2. Floor treatment system according to claim 1, wherein the respective connecting elements form electrical contact elements for the resistive coupling of the floor treatment unit to the charging station.

3. Floor treatment system according to claim 1, wherein the electrical connecting elements comprise at least two first connecting elements, and a number of second connecting elements, each of said at least two first connecting elements being associated with at least one of said second connecting elements.

4. Floor treatment system according to claim 3, wherein the first connecting elements are vertically spaced apart.

5. Floor treatment system according to claim 1, wherein the electrical connecting elements comprise a number of spaced-apart second connecting elements and with at least one associated first connecting element.

6. Floor treatment system according to claim 5, wherein, depending on the alignment of the floor treatment unit in relation to the charging station, one or more of the second connecting elements can be electrically connected to the associated first connecting element.

7. Floor treatment system according to claim 5, wherein the second connecting elements respectively associated with a first connecting element are disposed in a plane.

8. Floor treatment system according to claim 1, wherein at least one of the respective connecting elements has an associated elongated contact area.

9. Floor treatment system according to claim 8, wherein the at least one connecting element takes the form of a strip.

10. Floor treatment system according to claim 8, wherein the at least one connecting element having said elongated contact area is spring-mounted.

11. Floor treatment system according to claim 8, wherein the at least one connecting element having said elongated contact area forms a leaf spring.

12. Floor treatment system according to claim 8, wherein the at least one connecting element having said elongated contact area is disposed on the charging station.

13. Floor treatment system according to claim 8, wherein a number of contact pins are associated with the at least one connecting element.

14. Floor treatment system according to claim 1, wherein two horizontally aligned, leaf-spring-like connecting elements are disposed on the charging station one above the other, respectively associated with which are at least two contact pins mounted on the floor treatment unit.

15. Floor treatment system according to claim 1, wherein the floor treatment unit forms a mobile suction device with a suction turbine and a dirt collecting container having a suction inlet.

16. Floor treatment system according to claim 15, wherein the charging station comprises a suction-extraction assembly and a dirt receiving container, it being possible during the recharging of the power supply unit for the dirt collecting container to be emptied at the same time by the suction-extraction assembly via the suction inlet.

* * * * *